US009902046B2

(12) United States Patent
Moren et al.

(10) Patent No.: US 9,902,046 B2
(45) Date of Patent: Feb. 27, 2018

(54) NONWOVEN ABRASIVE ARTICLE WITH WAX ANTILOADING COMPOUND AND METHOD OF USING THE SAME

(71) Applicant: 3M INNOVATIVE PROPERTIES COMPANY, St. Paul, MN (US)

(72) Inventors: Louis S. Moren, Mahtomedi, MN (US); Scott M. Mevissen, White Bear Lake, MN (US); Edward J. Woo, Woodbury, MN (US); Jasmeet Kaur, Sandy Springs, GA (US)

(73) Assignee: 3M Innovative Properties Company, St. Paul, MN (US)

( * ) Notice: Subject to any disclaimer, the term of this patent is extended or adjusted under 35 U.S.C. 154(b) by 176 days.

(21) Appl. No.: 15/022,290

(22) PCT Filed: Sep. 4, 2014

(86) PCT No.: PCT/US2014/054094

§ 371 (c)(1),
(2) Date: Mar. 16, 2016

(87) PCT Pub. No.: WO2015/038401

PCT Pub. Date: Mar. 19, 2015

(65) Prior Publication Data

US 2016/0229032 A1 Aug. 11, 2016

Related U.S. Application Data

(60) Provisional application No. 61/878,269, filed on Sep. 16, 2013.

(51) Int. Cl.
*B24D 11/02* (2006.01)
*B24D 11/00* (2006.01)
(Continued)

(52) U.S. Cl.
CPC ..... *B24D 11/00* (2013.01); *B24B 1/00* (2013.01); *B24D 3/00* (2013.01); *B24D 3/34* (2013.01); *B24D 11/02* (2013.01)

(58) Field of Classification Search
CPC ..... B24D 11/00; B24D 11/02; B24D 3/00; B24D 3/04; B24B 1/00
(Continued)

(56) References Cited

U.S. PATENT DOCUMENTS 2,958,593 A * 11/1960 Hoover ..... A47L 13/04 451/532
4,018,575 A 4/1977 Davis
(Continued)

FOREIGN PATENT DOCUMENTS

CN 1222108 A 7/1999
CN 1291125 A 4/2001
(Continued)

OTHER PUBLICATIONS

Castorwax® MP-80, Hydrogenated Castor Oil, 2011, 1 page, downloaded from http://www.hallstar.com/pis.php?product=11002 on Aug. 20, 2013.
(Continued)

*Primary Examiner* — George Nguyen
(74) *Attorney, Agent, or Firm* — Bradford B. Wright

(57) ABSTRACT

A nonwoven abrasive article includes: a lofty open nonwoven fiber web, an abrasive layer bonded to the lofty open nonwoven fiber web, and a peripheral antiloading composition disposed on the abrasive layer. The peripheral antiloading composition comprises at least 50 percent by weight of wax having a melting point onset of from 180° F. (82° C.) to 290° F. (143° C.). A method of abrading a workpiece using the nonwoven abrasive article is also disclosed.

8 Claims, 1 Drawing Sheet

(51) Int. Cl.
*B24D 3/34* (2006.01)
*B24B 1/00* (2006.01)
*B24D 3/00* (2006.01)

(58) Field of Classification Search
USPC ..... 451/59
See application file for complete search history.

(56) References Cited

U.S. PATENT DOCUMENTS

| | | | | |
|---|---|---|---|---|
| 4,227,350 | A | 10/1980 | Fitzer | |
| 4,314,827 | A | 2/1982 | Leitheiser | |
| 4,331,453 | A | 5/1982 | Dau | |
| 4,518,397 | A | 5/1985 | Leitheiser | |
| 4,609,380 | A | 9/1986 | Barnett | |
| 4,623,364 | A | 11/1986 | Cottringer | |
| 4,652,275 | A | 3/1987 | Bloecher | |
| 4,744,802 | A | 5/1988 | Schwabel | |
| 4,770,671 | A | 9/1988 | Monroe | |
| 4,799,939 | A | 1/1989 | Bloecher | |
| 4,881,951 | A | 11/1989 | Wood | |
| 4,973,338 | A | 11/1990 | Gaeta | |
| 4,991,362 | A | 2/1991 | Heyer | |
| 5,011,508 | A | 4/1991 | Wald | |
| 5,090,968 | A | 2/1992 | Pellow | |
| 5,139,978 | A | 8/1992 | Wood | |
| 5,178,646 | A | 1/1993 | Barber, Jr. | |
| 5,201,916 | A | 4/1993 | Berg | |
| 5,227,104 | A | 7/1993 | Bauer | |
| 5,346,516 | A | 9/1994 | Alkhas | |
| 5,366,523 | A | 11/1994 | Rowenhorst | |
| 5,378,251 | A | 1/1995 | Culler | |
| 5,429,647 | A | 7/1995 | Larmie | |
| 5,498,269 | A | 3/1996 | Larmie | |
| 5,549,962 | A | 8/1996 | Holmes | |
| 5,551,963 | A | 9/1996 | Larmie | |
| 5,554,068 | A | 9/1996 | Carr | |
| 5,578,097 | A | 11/1996 | Gaeta | |
| 5,591,239 | A | 1/1997 | Larson | |
| 5,595,578 | A * | 1/1997 | Stubbs | B24D 3/28 51/295 |
| 5,667,542 | A * | 9/1997 | Law | B24D 3/28 51/293 |
| 5,681,361 | A | 10/1997 | Sanders, Jr. | |
| 5,704,952 | A | 1/1998 | Law | |
| 5,712,210 | A | 1/1998 | Windisch | |
| 5,858,140 | A | 1/1999 | Berger | |
| 5,908,477 | A * | 6/1999 | Harmer | B24D 3/004 451/59 |
| 5,928,070 | A * | 7/1999 | Lux | B24D 3/00 451/526 |
| 5,942,015 | A | 8/1999 | Culler | |
| 5,954,844 | A | 9/1999 | Law | |
| 6,017,831 | A | 1/2000 | Beardsley | |
| 6,207,246 | B1 | 3/2001 | Moren | |
| 6,302,930 | B1 | 10/2001 | Lux | |
| 8,034,137 | B2 | 10/2011 | Erickson | |
| 8,123,828 | B2 | 2/2012 | Culler | |
| 8,142,531 | B2 | 3/2012 | Adefris | |
| 8,142,532 | B2 | 3/2012 | Erickson | |
| 2003/0079415 | A1 * | 5/2003 | Carter | B24D 3/285 51/295 |
| 2006/0041065 | A1 | 2/2006 | Barber, Jr. | |
| 2009/0233528 | A1 * | 9/2009 | Mansfield | B24D 11/02 451/28 |

FOREIGN PATENT DOCUMENTS

| | | |
|---|---|---|
| WO | WO 97/42006 A1 | 11/1997 |
| WO | WO 99/51400 A1 | 10/1999 |
| WO | WO 2002-062531 | 8/2002 |
| WO | WO 2006-017008 | 2/2006 |
| WO | WO 2008-130779 | 10/2008 |

OTHER PUBLICATIONS

Natural Pigments, Castor Wax, 2013, 3 pages, downloaded from http://www.naturalpigments.com/detail.asp?Product_ID=510-15CWX50 on Aug. 20, 2013.
Wolfmeier, "Waxes", Ullmann's Encyclopedia of Industrial Chemistry, 2012, vol. 39, pp. 112-172.
International Search Report for PCT International Application No. PCT/US2014/054094, dated Dec. 12, 2014, 3 pages.

* cited by examiner

NONWOVEN ABRASIVE ARTICLE WITH WAX ANTILOADING COMPOUND AND METHOD OF USING THE SAME

TECHNICAL FIELD

The present disclosure broadly relates to the field of nonwoven abrasive articles.

BACKGROUND

Nonwoven abrasive articles generally include abrasive particles bonded to a nonwoven fiber web by a binder composition. In one common type of nonwoven abrasive article, the nonwoven fiber web includes a lofty open (i.e., not compact or tightly entangled) fiber web made by a process other than weaving or knitting. Examples of known techniques for forming nonwoven fiber webs include card and cross-lap, and air laid techniques using staple fiber. Typically, the fibers are held together mechanically (e.g., by needletacking) and/or by use of a prebond resin that is applied before the binder composition abrasive particles, although this is not always done. Nonwoven abrasive articles are widely used for many polishing, grinding, and machining purposes.

Nonwoven abrasives articles are used to abrade a wide variety of substrates or workpieces made from, for example, wood, plastic, fiberglass, or soft metal alloys, or having a layer of enamel or paint. Typically, there is some degree of space between these abrasive particles. During the abrading process, material abraded from the substrate or workpiece, also known as swarf, tends to fill the spaces between abrasive particles. The filling of spaces between abrasive particles and/or fibers with swarf and the subsequent build-up of swarf is known as loading. Loading presents a concern because the life of the abrasive article is reduced and the cut rate of the abrasive article decreases (thus, more force may be required to abrade). In addition, loading is an exponential problem; once swarf begins to fill in the spaces between abrasive particles, the initial swarf acts as a "seed" or "nucleus" for additional loading.

To address the problem of loading, antiloading compositions have been applied to non-woven abrasive articles. These compositions often contain antiloading agents such as, e.g., metal stearates, in a binder resin. There remains a need for improved antiloading compositions for nonwoven abrasive articles that includes a lofty open fiber web.

SUMMARY

In one aspect, the present disclosure provides a nonwoven abrasive article comprising:

a lofty open nonwoven fiber web comprising intertwined fibers;

an abrasive layer bonded to at least a portion of the lofty open nonwoven fiber web, the abrasive layer comprising abrasive particles retained in a binder composition; and a peripheral antiloading composition at least partially disposed on the abrasive layer, wherein the peripheral antiloading composition comprises at least 50 percent by weight of wax, wherein the wax has a melting point onset in the range of from 180° F. (82° C.) to 290° F. (143° C.). Preferably, the entire melting range of the wax is in the range of from 180° F. (82° C.) to 290° F. (143° C.), although this is not a requirement.

Nonwoven abrasive articles according to the present disclosure are useful; for example, for abrading a workpiece.

Advantageously, nonwoven abrasive articles according to the present disclosure exhibit improved abrading performance as compared to prior non-woven abrasive articles of comparable design.

Accordingly, in a second aspect, the present disclosure provides a method of abrading a workpiece, the method comprising:

frictionally contacting a nonwoven abrasive article with a workpiece, wherein the nonwoven abrasive article comprises: a lofty open nonwoven fiber web comprising intertwined fibers; an abrasive layer bonded to at least a portion of the lofty open nonwoven fiber web, the abrasive layer comprising abrasive particles retained in a binder composition; and a peripheral antiloading composition at least partially disposed on the abrasive layer, wherein the peripheral antiloading composition comprises at least 50 percent by weight of wax, wherein the wax has a melting point onset in the range of from 180° F. (82° C.) to 290° F. (143° C.); and moving the nonwoven abrasive article relative to the workpiece thereby abrading the workpiece.

As used herein, the term "wax" is defined as a composition having the following properties:

a) a melt viscosity not exceeding 10 Pascal-seconds at 10° C. above the melting point;
b) being polishable under slight pressure and having a strongly temperature-dependent consistency and solubility;
c) at 20° C. it must be kneadable or hard to brittle, coarse to finely crystalline, transparent to opaque, but not glassy, or highly viscous or liquid;
d) melting point between 40° C. and 200° C. without decomposition;
e) above the melting point, the viscosity should exhibit a strongly negative temperature dependence and the liquid should not tend to stringiness;
f) burns with a sooty flame after ignition; and
g) can form a paste and/or gel, and is a poor conductor of heat and electricity.

As used herein, "° C." refers to degrees Celsius, and "° F." refers to degrees Fahrenheit.

As used herein, the term "m.p." refers to melting point or melting range as indicated.

Features and advantages of the present disclosure will be further understood upon consideration of the detailed description as well as the appended claims.

Figure 1:
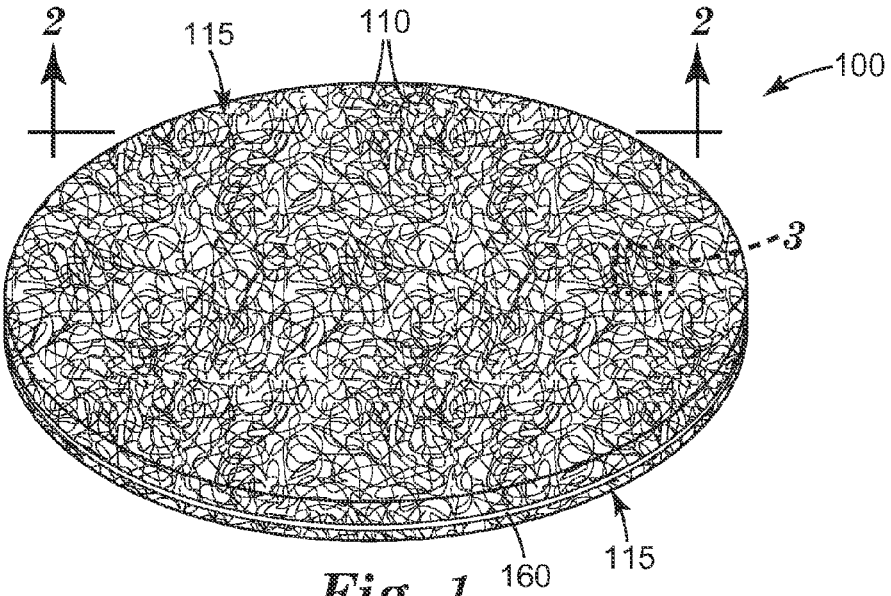
FIG. 1 is a schematic perspective view of an exemplary nonwoven abrasive disc 100 according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figure may not be drawn to scale.

DETAILED DESCRIPTION

Figure 2:
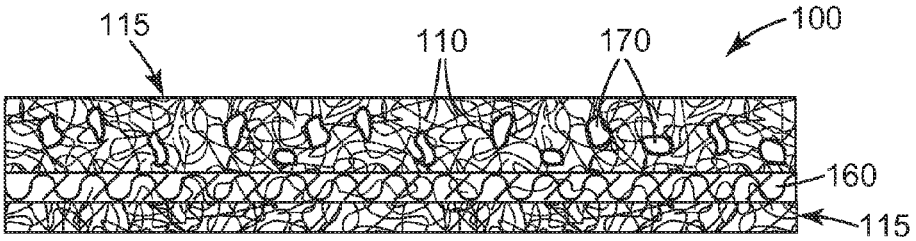
FIG. 2 is a schematic cross-sectional view of nonwoven abrasive disc 100 taken along plane 2-2.
Figure 3:
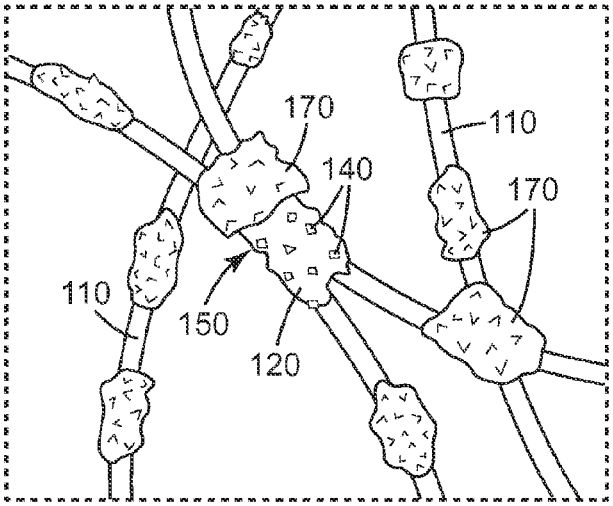
FIG. 3 is an enlarged view of region 3 of the nonwoven abrasive disc shown in FIG. 1.

An exemplary nonwoven abrasive article 100 according to the present disclosure is shown in FIGS. 1-3. Referring to FIG. 2, wherein lofty open nonwoven fiber web 115 is formed of intertwined fibers 110 extending through and secured to optional scrim 160. Referring now to FIG. 3, abrasive layer 150 is bonded to lofty open nonwoven fiber web 100 (e.g., at points of contact between fibers 110), thereby helping to bond fibers 110 to each other. Abrasive layer 150 includes binder composition 120 and abrasive particles 140 retained in binder composition 120. Peripheral antiloading composition 170 is disposed on abrasive layer 150 and fibers 110.

Nonwoven abrasive articles (e.g., webs and sheets) according to the present disclosure may be manufactured through processes that include common steps. In one method, a curable composition comprising a binder precursor and abrasive particles (e.g., as a slurry) is coated onto a lofty open nonwoven fiber web comprising intertwined fibers. In an alternative method, the curable composition is coated on the lofty open nonwoven fiber web, and then abrasive particles are deposited on the curable material prior to curing.

Suitable lofty open nonwoven fiber webs suitable for use in the aforementioned abrasive articles are well known in the abrasives art. The fibers may comprise continuous fiber, staple fiber, or a combination thereof. For example, the fiber web may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish.

The fiber web may be made, for example, by conventional air laid, carded, stitch bonded, spun bonded, wet laid, and/or melt blown procedures. Air laid fiber webs may be prepared using equipment such as, for example, that available under the trade designation RANDO WEBBER from Rando Machine Company of Macedon, N.Y.

The fiber web is typically reinforced, for example, using a prebond resin (e.g., a phenolic, urethane, or acrylic resin), by including core-sheath melty fibers, and/or by mechanical entanglement (e.g., hydroentanglement, or needletacking) using methods well-known in the art. The fiber web may optionally incorporate or be secured to a scrim and/or backing (e.g., using glue or a hot-melt adhesive or by needletacking), if desired, for additional reinforcement. Nonwoven fiber webs are typically selected to be suitably compatible with adhering binders and abrasive particles while also being processable in combination with other components of the article, and typically can withstand processing conditions (e.g., temperatures) such as those employed during application and curing of the curable composition. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, or polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped. Combinations of fibers may also be used.

Prior to coating with the curable composition, the lofty open nonwoven fiber web typically has a weight per unit area (i.e., basis weight) of at least about 100 grams per square meter (gsm), at least about 200 gsm, or at least about 300 gsm; and/or less than about 500 gsm, less than about 450 gsm, or less than about 400 gsm, as measured prior to any coating (e.g., with the curable composition or optional pre-bond resin), although greater and lesser basis weights may also be used. In addition, prior to impregnation with the curable composition, the fiber web typically has a thickness of at least about 1 millimeters (mm), at least about 2 mm, or at least about 3 mm; and/or less than about 100 mm, less than about 50 mm, or less than about 25 mm, although greater and lesser thicknesses may also be useful.

Frequently, as known in the abrasive art, it is useful to apply a pre-bond resin to the nonwoven fiber web prior to coating with the curable composition. The pre-bond resin serves, for example, to help maintain the nonwoven fiber web integrity during handling, and may also facilitate bonding of the urethane binder to the nonwoven fiber web. Examples of prebond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In those cases, wherein the nonwoven fiber web includes thermally bondable fibers, thermal bonding of the nonwoven fiber web may also be helpful to maintain web integrity during processing. Various other optional conventional treatments and additives may be used in conjunction with the nonwoven fiber web such as, for example, application of antistatic agents, lubricants, or corona treatment.

Further details concerning suitable fiber webs and methods for their manufacture may be found, for example, in U.S. Pat. No. 6,207,246 (Moren et al.); U.S. Pat. No. 5,591,239 (Larson et al.); U.S. Pat. No. 4,227,350 (Fitzer); and U.S. Pat. No. 2,958,593 (Hoover et al.).

The binder composition is generally formed by curing a curable binder precursor composition after it is coated on the nonwoven fiber web. The binder precursor is typically applied to the fiber web in liquid form (e.g., by conventional methods), and subsequently hardened (e.g., at least partially cured).

Useful binder precursors may comprise a monomeric or polymeric material that may be at least partially cured (e.g., polymerized and/or crosslinked). Typically, upon at least partial curing, such binder precursors form a non-elastomeric binder (e.g., a hard brittle binder) that bonds abrasive particles to the fiber web. The binder composition may have a Knoop hardness number (KHN, expressed in kilograms-force per millimeter (kgf/mm)) of, for example, at least about 20 kgf/mm, at least about 40 kgf/mm, at least about 60 kgf/mm, or at least about 80 kgf/mm.

Suitable binder precursors include condensation-curable materials and/or addition-polymerizable materials. Such binder precursors may be solvent-based, water-based, or 100 percent solids. Exemplary binder precursors include phenolic resins, bismaleimides, vinyl ethers, aminoplasts, urethane prepolymers, epoxy resins, acrylates, acrylated isocyanurates, urea-formaldehyde resins, isocyanurates, acrylated urethanes, acrylated epoxies, or mixtures of any of the foregoing. Phenolic resins and epoxy resins, and combinations thereof, are among preferred binder precursors due to their high performance, wide availability, and low cost.

Exemplary phenolic resins suitable for use in binder precursors include resole phenolic resins and novolac phenolic resins. Exemplary commercially available phenolic materials include those having the trade designations "DUREZ" or "VARCUM" (available from Durez Corporation, Novi, Mich.); "AROFENE" or "AROTAP" (available from Ashland Chemical Company, Columbus, Ohio); and "BAKELITE" (available from Momentive Specialty Chemicals, Columbus, Ohio). Further details concerning suitable phenolic resins may be found, for example, in U.S. Pat. No. 5,591,239 (Larson et al.) and U.S. Pat. No. 5,178,646 (Barber, Jr. et al.).

Exemplary epoxy resins include the diglycidyl ether of bisphenol A, as well as materials that are commercially available under the trade designation "EPON" (e.g., EPON 828, EPON 1004, and EPON 1001F) from Momentive Specialty Chemicals; and under the trade designations "D.E.R." (e.g., D.E.R. 331, D.E.R. 332, and D.E.R. 334) or "D.E.N." (e.g., D.E.N. 431 and D.E.N. 428) from Dow Chemical Company, Midland, Mich.

Exemplary urea-formaldehyde resins and melamine-formaldehyde resins include those commercially available as UFORMITE from Cytec Technology Corporation, Wilmington Del.; as DURITE from Momentive Specialty Chemicals; and as RESIMENE from INEOS Melamines GmbH. Frankfort, Germany.

Examples of useful urethane prepolymers include polyisocyanates and blocked versions thereof. Typically, blocked polyisocyanates are substantially unreactive to isocyanate reactive compounds (e.g., amines, alcohols, thiols, etc.) under ambient conditions (e.g., temperatures in a range of from about 20° C. to about 25° C.), but upon application of sufficient thermal energy the blocking agent is released, thereby generating isocyanate functionality that reacts with the amine curative to form a covalent bond.

Useful polyisocyanates include, for example, aliphatic polyisocyanates (e.g., hexamethylene diisocyanate or trimethylhexamethylene diisocyanate); alicyclic polyisocyanates (e.g., hydrogenated xylylene diisocyanate or isophorone diisocyanate); aromatic polyisocyanates (e.g., tolylene diisocyanate or 4,4'-diphenylmethane diisocyanate); adducts of any of the foregoing polyisocyanates with a polyhydric alcohol (e.g., a diol, low molecular weight hydroxyl group-containing polyester resin, water, etc.); adducts of the foregoing polyisocyanates (e.g., isocyanurates, biurets); and mixtures thereof.

Useful commercially available polyisocyanates include, for example, those available under the trade designations: "ADIPRENE" from Chemtura Corporation, Middlebury, Conn. (e.g., ADIPRENE L 0311, ADIPRENE L 100, ADIPRENE L 167, ADIPRENE L 213, ADIPRENE L 315, ADIPRENE L 680, ADIPRENE LF 1800A, ADIPRENE LF 600D, ADIPRENE LFP 1950A, ADIPRENE LFP 2950A, ADIPRENE LFP 590D, ADIPRENE LW 520, and ADIPRENE PP 1095); "MONDUR" from Bayer Corporation, Pittsburgh, Pa. (e.g., MONDUR 1437, MONDUR MP-095, or MONDUR 448); and "AIRTHANE" and "VERSATHANE" from Air Products and Chemicals, Allentown, Pa. (e.g., AIRTHANE APC-504, AIRTHANE PST-95A, AIRTHANE PST-85A, AIRTHANE PET-91A, AIRTHANE PET-75D, VERSATHANE STE-95A, VERSATHANE STE-P95, VERSATHANE STS-55, VERSATHANE SME-90A, and VERSATHANE MS-90A).

To lengthen pot-life, polyisocyanates such as, for example, those mentioned above may be blocked with a blocking agent according to various techniques known in the art. Exemplary blocking agents include ketoximes (e.g., 2-butanone oxime); lactams (e.g., epsilon-caprolactam); malonic esters (e.g., dimethyl malonate and diethyl malonate); pyrazoles (e.g., 3,5-dimethylpyrazole); alcohols including tertiary alcohols (e.g., t-butanol or 2,2-dimethylpentanol), phenols (e.g., alkylated phenols), and mixtures of alcohols as described.

Exemplary useful commercially-available blocked polyisocyanates include those marketed by Chemtura Corporation as ADIPRENE BL 11, ADIPRENE BL 16, and ADIPRENE BL 31, and blocked polyisocyanates marketed by Baxenden Chemicals, Ltd., Accrington, England under the trade designation "TRIXENE" (e.g., TRIXENE BL 7641, TRIXENE BL 7642, TRIXENE BL 7772, and TRIXENE BL 7774).

Typically, the amount of urethane prepolymer present in the binder precursor is in an amount of from 10 to 40 percent by weight, more typically in an amount of from 15 to 30 percent by weight, and even more typically in an amount of from 20 to 25 percent by weight based on the total weight of the binder precursor, although amounts outside of these ranges may also be used.

Suitable amine curatives for urethane prepolymers include aromatic, alkyl-aromatic, or alkyl polyfunctional amines, preferably primary amines. Examples of useful amine curatives include 4,4'-methylenedianiline; polymeric methylene dianilines having a functionality of 2.1 to 4.0 available as CURITHANE 103 from the Dow Chemical Company, and as MDA-85 from Bayer Corporation; 1,5-diamine-2-methylpentane; tris(2-aminoethyl)amine; 3-aminomethyl-3,5,5-trimethylcyclohexylamine (i.e., isophoronediamine), trimethylene glycol di-p-aminobenzoate, bis(o-aminophenylthio)ethane, 4,4'-methylenebis(dimethyl anthranilate), bis(4-amino-3-ethylphenyl)methane (e.g., marketed as KAYAHARD AA by Nippon Kayaku Company, Ltd., Tokyo, Japan), and bis(4-amino-3,5-diethylphenyl) methane (e.g., marketed as LONZACURE M-DEA by Lonza, Ltd., Basel, Switzerland); and mixtures thereof. If desired, polyol(s) may be added to the curable composition, for example, to modify (e.g., to retard) cure rates as required by the intended use.

Optionally, but typically, the binder precursor further includes one or more catalysts and/or curing agents to initiate and/or accelerate the curing process (e.g., thermal catalyst, hardener, crosslinker, photocatalyst, thermal initiator, and/or photoinitiator) as well as in addition, or alternatively, other known additives such as fillers, thickeners, tougheners, grinding aids, pigments, fibers, tackifiers, lubricants, wetting agents, surfactants, antifoaming agents, dyes, coupling agents, plasticizers, suspending agents, bactericides, fungicides, grinding aids, and antistatic agents. The selection and amounts of appropriate catalysts, curing agents, and other additives is within the capability of one of ordinary skill in the art.

The binder precursor may include at least one organic solvent (e.g., isopropyl alcohol or methyl ethyl ketone) to facilitate coating onto the nonwoven fiber web, although this is not a requirement.

Exemplary lubricants include metal stearate salts such as lithium stearate and zinc stearate, molybdenum disulfide, and mixtures thereof.

As used herein, the term "grinding aid" refers to a non-abrasive (e.g., having a Mohs hardness of less than 7) particulate material that has a significant effect on the chemical and physical processes of abrading. In general, the addition of a grinding aid increases the useful life of a nonwoven abrasive. Exemplary grinding aids include inorganic and organic materials, include waxes, organic halides (e.g., chlorinated waxes, polyvinyl chloride), halide salts (e.g., sodium chloride, potassium cryolite, cryolite, ammonium cryolite, potassium tetrafluoroborate, sodium tetrafluoroborate, silicon fluorides, potassium chloride, magnesium chloride), metals (e.g., tin, lead, bismuth, cobalt, antimony, cadmium, iron, and titanium and their alloys), sulfur, organic sulfur compounds, metallic sulfides, graphite, and mixtures thereof.

Binder precursors may typically be cured by exposure to, for example, thermal energy (e.g., by direct heating, induction heating, and/or by exposure to microwave and/or infrared electromagnetic radiation) and/or actinic radiation (e.g., ultraviolet light, visible light, particulate radiation). Exemplary sources of thermal energy include ovens, heated rolls, and infrared lamps.

Suitable methods for applying binder precursors (whether alone or as a slurry in combination with abrasive particles) are well known in the art of nonwoven abrasive articles, and include coating methods such as curtain coating, roll coating, spray coating, and the like. Typically, spray coating is an effective and economical method. Exemplary slurry coating techniques are described, for example, in U.S. Pat. Nos. 5,378,251 and 5,942,015 (both to Culler et al.).

Abrasive particles suitable for use in abrasive compositions utilized in practice according to the present disclosure include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof. Desirably, the abrasive particles comprise fused aluminum oxide, heat-treated aluminum oxide, ceramic aluminum oxide, silicon carbide, alumina zirconia, garnet, diamond, cubic boron nitride, sol-gel derived abrasive particles, or mixtures thereof. Examples of sol-gel abrasive particles include those described U.S. Pat. No. 4,314,827 (Leitheiser et al.); U.S. Pat. No. 4,518,397 (Leitheiser et al.); U.S. Pat. No. 4,623,364 (Cottringer et al.); U.S. Pat. No. 4,744,802 (Schwabel); U.S. Pat. No. 4,770,671 (Monroe et al.); U.S. Pat. No. 4,881,951 (Wood et al.); U.S. Pat. No. 5,011,508 (Wald et al.); U.S. Pat. No. 5,090,968 (Pellow); U.S. Pat. No. 5,139,978 (Wood); U.S. Pat. No. 5,201,916 (Berg et al.); U.S. Pat. No. 5,227,104 (Bauer); U.S. Pat. No. 5,366,523 (Rowenhorst et al.); U.S. Pat. No. 5,429,647 (Larmie); U.S. Pat. No. 5,498,269 (Larmie); and U.S. Pat. No. 5,551,963 (Larmie). The abrasive particles may be in the form of, for example, individual particles, agglomerates, composite particles, and mixtures thereof. Exemplary agglomerates and composite particles are described, for example, in U.S. Pat. No. 4,652,275 (Bloecher et al.); U.S. Pat. No. 4,799,939 (Bloecher et al.); and U.S. Pat. No. 5,549,962 (Holmes et al.).

The abrasive particles may, for example, have an average diameter of at least about 0.1 micrometer, at least about 1 micrometer, or at least about 10 micrometers, and less than about 2000, less than about 1300 micrometers, or less than about 1000 micrometers, although larger and smaller abrasive particles may also be used. For example, the abrasive particles may have an abrasives industry specified nominal grade. Such abrasives industry accepted grading standards include those known as the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include P8, P12, P16, P24, P36, P40, P50, P60, P80, P100, P120, P150, P180, P220, P320, P400, P500, 600, P800, P1000, and P1200. Exemplary JIS grade designations include HS8, JI512, JI516, J1524, J1536, J1546, J1554, JI560, JI580, JIS100, JI5150, JI5180, J15220, J15240, J15280, J15320, J15360, JI5400, JI5400, JI5600, JI5800, JIS1000, JIS1500, J152500, JI54000, JI56000, JI58000, and JIS10000.

Useful abrasive particles also include shaped ceramic abrasive particles as described in U.S. Pat. No. 8,142,532 (Erickson et al.); U.S. Pat. No. 8,142,531 (Adefris et al.); U.S. Pat. No. 8,123,828 Ser. No. (Culler et al.); and U.S. Pat. No. 8,034,137 (Erickson et al.).

Typically, the coating weight for the abrasive particles (independent of other ingredients in the curable composition) may depend, for example, on the particular curable urethane prepolymer used, the process for applying the abrasive particles, and the size of the abrasive particles. For example, the coating weight of the abrasive particles on the nonwoven fiber web (before any compression) may be at least 200 grams per square meter (g/m), at least 500 g/m, or at least 700 g/m; and/or less than 2000 g/m, less than about 1600 g/m, or less than about 1200 g/m, although other coating weights may be also be used.

As an alternative to application as slurry with binder precursor, abrasive particles may be applied to a nonwoven fiber web having a binder precursor coated thereon using methods known in the abrasive art for application of such particles. For example, the abrasive particles may be applied by blowing or dropping the particles onto uncured binder precursor, or by a combination thereof.

Further details concerning nonwoven abrasive articles and methods for their manufacture may be found, for example, in U.S. Pat. No. 2,958,593 (Hoover et al.); U.S. Pat. No. 4,018,575 (Davis et al.); U.S. Pat. No. 4,227,350 (Fitzer); U.S. Pat. No. 4,331,453 (Dau et al.); U.S. Pat. No. 4,609,380 (Barnett et al.); U.S. Pat. No. 4,991,362 (Heyer et al.); U.S. Pat. No. 5,554,068 (Carr et al.); U.S. Pat. No. 5,712,210 (Windisch et al.) U.S. Pat. No. 5,591,239 (Larson et al.); U.S. Pat. No. 5,681,361 (Sanders); U.S. Pat. No. 5,858,140 (Berger et al.); U.S. Pat. No. 5,928,070 (Lux); U.S. Pat. No. 6,017,831 (Beardsley et al.); U.S. Pat. No. 6,207,246 (Moren et al.); and U.S. Pat. No. 6,302,930 (Lux); and U.S. Pat. Appln. Publ. 2006/0041065 A1 (Barber, Jr.).

The peripheral antiloading composition is applied onto the abrasive layer and optionally nonwoven fiber web. It may cover all, or more typically some, of either or both of the abrasive layer and the nonwoven fiber web.

The peripheral antiloading composition comprises at least 50 percent by weight (based on the total weight of the peripheral antiloading composition) of wax having a melting point onset (i.e., that temperature at which melting begins at one atmosphere of pressure (101 kPa)) in the range of from 180° F. (82° C.) to 290° F. (143° C.). As used throughout the specification and claims the term wax refers to all the combined total of waxes in the peripheral antiloading composition. Individual wax components may melt outside the prescribed melting range as long as the total combination of all waxy components has the proper melting behavior.

Preferably, the peripheral antiloading composition comprises at least 60 percent by weight, more preferably at least 70 percent by weight, more preferably at least 80 percent by weight, more preferably at least 90 percent by weight, more preferably at least 95 percent by weight, and even more preferably at least 99 percent by weight, of wax having a melting point onset (i.e., that temperature at which melting begins) in the range of from 180° F. (82° C.) to 290° F. (143° C.). In some embodiments, the peripheral antiloading composition consists of one or more waxes having a melting point onset in the range of from 180° F. (82° C.) to 290° F. (143° C.).

Preferably, the wax having a melting point onset in the range of from 190° F. (82° C.) to 270° F. (143° C.), more preferably 200° F. (93.3° C.) to 250° F. (121° C.), and more preferably from 215° F. (102° C.) to 240° F. (116° C.).

Suitable waxes may include natural and synthetic waxes. Examples of suitable waxes include a synthetic hydrocarbon wax obtained as MP-22VF (m.p.=215-223° F. (102-106° C.)) from Micro Powders Inc., Tarrytown, N.Y.; a polyethylene wax for waterborne systems obtained as AQUAPOLY 215 (m.p.=221-232° F. (105-111° C.)) from Micro Powders Inc.; combinations of waxes such as, for example, a combination of polyethylene and carnauba wax obtained as MICROKLEAR 295 (m.p.=219-230° F. (104-110° C.)) from Micro Powders Inc.; a polyethylene wax for waterborne systems obtained as AQUAPOLY 250 (m.p.=243-253° F. (117-123° C.)) from Micro Powders Inc., Tarrytown, N.Y.; a high melting polyethylene wax (m.p.=253-257° F. (123-125° C.)) obtained as MPP-635VF from Micro Powders Inc.; a modified polypropylene wax (m.p.=284-289° F. (140-143° C.)) obtained as MICROPRO 200 from Micro Powders Inc.; and an EBS wax obtained as MICROMIDE 520 (m.p.=286-293° F. (141-145° C.)) from Micro Powders Inc.

In some embodiments, the peripheral antiloading composition further comprises a binder material (e.g., a cured and/or crosslinked polymeric binder material). Suitable binder materials include those discussed hereinabove with regard to the binder composition (e.g., phenolic resins and polyurethane resins). The amount of binder material is preferably less than 50 percent by weight (based on the total weight of the peripheral antiloading composition), more preferably less than 40 percent by weight, more preferably less than 30 percent by weight, more preferably less than 20 percent by weight, more preferably less than 10 percent by weight, more preferably less than 5 percent by weight, more preferably less than 1 percent by weight, or the peripheral antiloading composition may even be free of binder material.

In some embodiments, the peripheral antiloading composition contains less than 20 percent by weight, preferably less than 15 percent by weight, more preferably less than 10 percent by weight, more preferably less than 5 percent by weight, and more preferably less than 1 percent by weight of, or more preferably is free of, fatty acid metal salts, ammonium salts, and boronic esters, boronic acids, amines, phosphine oxides, sulfones, sulfates, sulfonates, sulfoxides, and ammonium compounds, and combinations thereof.

In some embodiments, the peripheral antiloading composition contains less than 20 percent by weight, preferably less than 15 percent by weight, more preferably less than 10 percent by weight, more preferably less than 5 percent by weight, and more preferably less than one percent by weight of, or more preferably is free of, fluorine.

Nonwoven abrasive articles according to the present disclosure may be converted to a variety of useful forms including, for example, sheets, discs, belts, rolls, wheels, hand pads, cleaning brushes, and blocks. Such techniques are well known in the art.

If desired, an attachment layer such as one part of a reclosable mechanical fastener (e.g., a capped stems fastener or one half of a hook and loop fastener), adhesive layer, or other mechanical fastener may be secured to one surface of the nonwoven abrasive article. If a scrim or a backing is present, that attachment layer may be proximate the scrim or backing.

Select Embodiments of the Present Disclosure

In a first embodiment, the present disclosure provides a nonwoven abrasive article comprising:

a lofty open nonwoven fiber web comprising intertwined fibers;

an abrasive layer bonded to at least a portion of the lofty open nonwoven fiber web, the abrasive layer comprising abrasive particles retained in a binder composition; and a peripheral antiloading composition at least partially disposed on the abrasive layer, wherein the peripheral antiloading composition comprises at least 50 percent by weight of wax, wherein the wax has a melting point onset in the range of from 180° F. (82° C.) to 290° F. (143° C.).

In a second embodiment, the present disclosure provides a nonwoven abrasive article according to the first embodiment, wherein the peripheral antiloading composition comprises at least 95 percent by weight of the wax.

In a third embodiment, the present disclosure provides a nonwoven abrasive article according to the first embodiment, wherein the peripheral antiloading composition comprises at least 99 percent by weight of the wax.

In a fourth embodiment, the present disclosure provides a nonwoven abrasive article according to any one of the first to third embodiments, wherein the wax comprises a microcrystalline polyethylene wax.

In a fifth embodiment, the present disclosure provides a nonwoven abrasive article according to any one of the first to fourth embodiments, wherein the peripheral antiloading coating further comprises a binder material.

In a sixth embodiment, the present disclosure provides a nonwoven abrasive article according to any one of the first to fifth embodiments, wherein the peripheral antiloading coating contains less than 20 percent by weight of fatty acid metal salts, ammonium salts, and boronic esters, boronic acids, amines, phosphine oxides, sulfones, sulfates, sulfonates, sulfoxides, and ammonium compounds combined.

In a seventh embodiment, the present disclosure provides a nonwoven abrasive article according to any one of the first to sixth embodiments, wherein the peripheral antiloading coating contains less than 20 percent by weight of fluorine.

In an eighth embodiment, the present disclosure provides a method of abrading a workpiece, the method comprising:

frictionally contacting a nonwoven abrasive article according to any one of the first to seventh embodiments with a workpiece; and moving the nonwoven abrasive article relative to the workpiece thereby abrading the workpiece.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

In the Examples, "StDev" refers to standard deviation.

The materials abbreviations in TABLE 1 (below) are used throughout the Examples.

TABLE 1

| ABBREVIATION | DESCRIPTION |
|---|---|
| WAX1 | 100% carnauba wax obtained as MICROKLEAR 418 from Micro Powders Inc., Tarrytown, New York |
| WAX2 | Synthetic hydrocarbon wax obtained as MP-22VF from Micro Powders Inc., Tarrytown, New York |
| WAX3 | A combination of polyethylene and carnauba wax obtained as MICROKLEAR 295 from Micro Powders Inc., Tarrytown, New York |
| WAX4 | A polyethylene wax for waterborne systems obtained as AQUAPOLY 215 from Micro Powders Inc., Tarrytown, New York |
| WAX5 | A high melting polyethylene wax obtained as MPP-635VF from Micro Powders Inc., Tarrytown, New York |
| WAX6 | A modified polypropylene wax obtained as MICROPRO 200 from Micro Powders Inc., Tarrytown, New York |
| WAX7 | An EBS wax obtained as MICROMIDE 520 from Micro Powders Inc., Tarrytown, New York |
| DIS1 | An aqueous dispersion of hydrocarbon wax (50% wax solids) in water obtained as MICROSPERSION 22-50 from Micro Powders Inc., Tarrytown, New York |
| COMP LUB1 | A dry grinding lubricant stick obtained as FOXFIRE from Rogen Corporation, Becker, Minnesota |
| COMP LUB 2 | Stearic acid (vegetable-based) flake obtained as TRIPLE PRESSED STEARIC ACID VEG(VEGETABLE BASED) FLAKES from Acme-Hardesty, Co, Blue Bell, Philadelphia, Pennsylvania |
| RES1 | A styrene-butadiene copolymer latex obtained as ROVENE 5900 from Mallard Creek Polymers, Charlotte, North Carolina |
| A1 | An antifoam obtained as GEO FM LTX from GEO Specialty Chemicals, Ambler, Pennsylvania |
| T1 | A 5% water dispersion of a polyacrylate powder obtained as CARBOPOL EZ-3 from the Lubrizol Corporation, Wickliffe, Ohio |

Abrasion Test Method

A 3-inch (7.62-cm) diameter nonwoven abrasive disc to be tested was mounted on an electric rotary tool that was disposed over an X-Y table having a panel measuring 6 inches×14 inches×1 inch (152.4 mm×355.6 mm×25.4 mm) secured to the X-Y table. The tool was then set to traverse at a rate of 14 inches/second (355.6 mm/sec) in the Y direction along the length of the panel; and a traverse along the width of the panel at a rate of 4.70 inches/second (119.4 mm/sec). Twenty such passes along the length of the panel were completed in each cycle for a total of 8 cycles. The rotary tool was then activated to rotate at 11000 rpm under no load. The abrasive article was then urged at an angle of 5 degrees against the panel at a load of 5 lbs (2.27 kg). The tool was then activated to move through the prescribed path. The mass of the panel was measured before and after each cycle to determine the total mass loss in grams after each cycle as well as a cumulative mass loss was determined at the end of 8 cycles. The disc was weighed before and after the completion of the test (8 cycles) to determine the wear. The number of samples tested for each example is shown in Tables 2, 3 and 5.

Schiefer Test

A nonwoven abrasive article to be tested was converted into a 10.2 cm diameter disc and secured to a foam back-up pad by means of a hook and loop attachment system. The coated abrasive disc and back-up pad assembly was installed on a Schiefer testing machine (available from Frazier Precision Company, Gaithersburg, Md.), and the coated abrasive disc was used to abrade an annular ring (10.2 cm outside diameter (OD)×5.1 cm inside diameter (ID)) of T6061 aluminum alloy. The applied load was 4.54 kilograms (kg). The test period was 4000 revolutions or cycles of the coated abrasive disc. The amount of aluminum alloy removed was measured at the end of the test

Abrasive Article Preparation

Examples 1 to 7

Nonwoven abrasive articles of Examples 1 to 7 were prepared using a scrim-backed nonwoven abrasive of approximate total weight of 430 grains per 24 square inches (1800 g/m$^2$) available in 7-inch (17.8-cm) disc form from 3M Company as 3M SCOTCH-BRITE SURFACE CONDITIONING DISC A MED and coating it with waxes with different melting points. To prepare lubricant-coated samples the nonwoven abrasive was cut into 3-inch (7.6-cm) discs, attached to a ROLOC button (available from 3M Company), and brush-coated with WAX1 powder at an approximate add-on of 25 grains per 24 square inches (105 g/m$^2$). The discs were heated at 275° F. (135° C.) for 15 minutes to melt the powder coating, cooled, and then tested according to the test method described earlier.

Example 2

The nonwoven abrasive article of Example 2 was prepared using the procedure described for Example 1, except that WAX1 was replaced with WAX2.

Example 3

The nonwoven abrasive article of Example 3 was prepared using the procedure described for Example 1, except that WAX1 was replaced with WAX3.

Example 4

The nonwoven abrasive article of Example 4 was prepared using the procedure described for Example 1, except that WAX1 was replaced with WAX4.

Example 5

The nonwoven abrasive article of Example 5 was prepared using the procedure described for Example 1, except that WAX1 was replaced with WAX5, and the heating temperature was changed to 325° F. (163° C.).

Example 6

The nonwoven abrasive article of Example 6 was prepared using the procedure described for Example 1, except that WAX1 was replaced with WAX6, and the heating temperature was changed to 325° F. (163° C.).

Example 7

The nonwoven abrasive article of Example 7 was prepared using the procedure described for Example 1, except that WAX1 was replaced with WAX7, and the heating temperature was changed to 325° F. (163° C.).

Comparative Example A

The nonwoven abrasive article of Comparative Example A was prepared as in Example 1, except that no wax was applied.

Comparative Example B

The nonwoven abrasive article of Comparative Example B was prepared using the procedure described for Example 1, except replacing WAX1 with COMP LUB 1, and changing the heating temperature to 225° F. (107° C.).

Comparative Example C

The nonabrasive article of Comparative Example C was prepared using the procedure described for Example 1, except replacing WAX1 with COMP LUB 2, and changing the heating temperature to 225° F. (107° C.).

Comparative Example D

The nonwoven abrasive article of Comparative Example D was a nonwoven abrasive available from the 3M Company as 3M SCOTCH-BRITE PD SURFACE CONDITIONING DISC A MED 7" (18-cm) discs. To prepare the sample for testing the non-woven abrasive was cut into 3-inch (8-cm) discs and attached to a ROLOC button.

Comparative Example E

The abrasive article of Comparative Example E was prepared using the procedure described for Example 1, except using the nonwoven abrasive article in Comparative Example D and WAX2.

Comparative Example F

The abrasive article of Comparative Example F was a nonwoven abrasive available from the Saint-Gobain Abrasives Inc. as NORTON VORTEX RAPID PREP MED 7" (18-cm) discs. To prepare the sample for testing the nonwoven abrasive was cut into 3-inch (8-cm) discs and attached to a ROLOC button.

Comparative Example G

The abrasive article of Comparative Example G was prepared using the procedure described for Example 1, except using the nonwoven abrasive in Comparative Example F and WAX2.

Results of performing the Abrasive Test on the above Examples are reported in Table 2 (below).

TABLE 2

| EXAMPLE | WAX | MELTING POINT, ° F. (° C.) | NUMBER OF SAMPLES | AVERAGE CUT, grams (StDev) | AVERAGE WEAR, grams (StDev) | CUT/WEAR RATIO (StDev) |
|---|---|---|---|---|---|---|
| 1 | WAX1 | 178-187 (81-86) | 2 | 30.48 (0.08) | 25.07 (0.62) | 1.22 (0.03) |
| 2 | WAX2 | 215-223 (102-106) | 5 | 30.34 (2.18) | 22.50 (1.43) | 1.35 (0.07) |
| 3 | WAX3 | 219-230 (104-110) | 1 | 26.26 | 17.36 | 1.51 |
| 4 | WAX4 | 221-232 (105-111) | 1 | 28.22 | 19.12 | 1.48 |
| 5 | WAX5 | 253-257 (123-125) | 2 | 29.53 (0.64) | 26.22 (0.55) | 1.13 (0.001) |
| 6 | WAX6 | 284-289 (140-143) | 1 | 27.74 | 22.77 | 1.22 |
| 7 | WAX7 | 286-293 (141-145) | 3 | 32.29 (3.68) | 27.52 (2.29) | 1.17 (0.07) |
| Comparative Example A | No lubricant coating | | 9 | 26.21 (0.77) | 31.72 (2.57) | 0.83 (0.05) |
| Comparative Example B | COMP LUB1 | 106-154 (41-68) | 2 | 31.59 (1.79) | 34.91 (0.95) | 0.91 (0.08) |
| Comparative Example C | COMP LUB2 | 153-162 (67-72) | 1 | 29.45 | 28.00 | 1.05 |
| Comparative Example D | none | n.a. | 5 | 28.62 (1.40) | 21.00 (3.51) | 1.36 (0.06) |
| Comparative Example E | WAX2 | 215-223 (102-106) | 1 | 35.24 | 16.21 | 2.17 |
| Comparative Example F | none | n.a. | 3 | 13.71 (0.85) | 8.73 (0.83) | 1.57 (0.05) |
| Comparative Example G | WAX2 | 215-223 (102-106) | 1 | 18.58 | 7.02 | 2.65 |

In Table 2, the melting points of Comparative Examples B and C were determined by Differential Scanning calorimetry, and correspond to the maximum heat flow point (peak of curve).

Examples 9-14

Nonwoven abrasive articles of Examples 9 to 14 were prepared according to the procedure of Example 1, except that the amount of WAX1 was varied as reported in Table 3 (below).

TABLE 3

| EXAMPLE | WAX TYPE | WAX1 ADD-ON, grains/24 in$^2$ (g/m$^2$) | NUMBER OF SAMPLES | CUT, grams | WEAR, grams | CUT/WEAR RATIO |
|---|---|---|---|---|---|---|
| 9 | WAX1 | 3.7 (15.5) | 1 | 27.94 | 28.78 | 0.97 |
| 10 | WAX1 | 6.0 (25.1) | 1 | 28.55 | 24.05 | 1.19 |
| 11 | WAX1 | 12.0 (50.2) | 1 | 28.78 | 23.18 | 1.24 |
| 12 | WAX1 | 16.8 (70.3) | 1 | 29.01 | 21.17 | 1.37 |
| 13 | WAX1 | 25.0 (104.7) | 1 | 29.35 | 22.12 | 1.33 |
| 14 | WAX1 | 40.0 (167.5) | 1 | 30.20 | 19.29 | 1.57 |

Examples 15-18

Abrasive articles of Example 15 through Example 18 were prepared using a scrim-backed nonwoven abrasive of approximate total weight of 430 grains per 24 square inches (1800 g/m$^2$) available in 7-inch (18-cm) disc form as 3M SCOTCH-BRITE SURFACE CONDITIONING DISC A MED from 3M Company, Saint Paul, Minn. To prepare the lubricant-coated samples of this invention the nonwoven abrasive was cut into 3-inch (7.6 cm) discs, attached to a ROLOC button from 3M Company, and brush coated with the aqueous wax solutions specified in Table 4. The coated discs were heated at 275° F. (135° C.) for 15 minutes to dry and melt the wax solution coating, cooled, and then tested according to the Abrasion Test. Results are reported in Table 5, wherein the wax melting point onset of 214° F. (101° C.) was determined by drying the wax dispersion DIS1 and measuring the melting point onset by Differential Scanning calorimetry.

TABLE 4

| | PERCENTAGE BY WEIGHT IN MIXTURE | | | |
|---|---|---|---|---|
| MATERIAL | SOL1 | SOL2 | SOL3 | SOL4 |
| Water | 50.22 | 55.43 | 55.34 | 54.87 |
| T1 | 2.46 | 0 | 0 | 0 |
| DIS1 | 47.25 | 39.88 | 35.32 | 31.06 |
| A1 | 0.07 | 0.01 | 0.01 | 0.01 |
| RES1 | 0 | 4.68 | 9.33 | 14.06 |
| % Resin in the Dried Mixture | 0 | 10.10 | 20.10 | 30.10 |

TABLE 5

| EXAMPLE | WAX SOLUTION | NUMBER OF SAMPLES | AVERAGE CUT, grams (StDev) | AVERAGE WEAR, grams (StDev) | CUT/WEAR RATIO (StDev) |
|---|---|---|---|---|---|
| Comparative Example A | None | 9 | 26.21 (0.77) | 31.72 (2.57) | 0.83 (0.05) |
| 15 | SOL1 | 2 | 32.33 (0.17) | 23.24 (1.75) | 1.40 (0.11) |

TABLE 5-continued

| EXAMPLE | WAX SOLUTION | NUMBER OF SAMPLES | AVERAGE CUT, grams (StDev) | AVERAGE WEAR, grams (StDev) | CUT/WEAR RATIO (StDev) |
|---|---|---|---|---|---|
| 16 | SOL2 | 5 | 29.54 (2.61) | 22.88 (0.91) | 1.3 (0.15) |
| 17 | SOL3 | 2 | 25.44 (0.74) | 21.60 (0.30) | 1.18 (0.02) |
| 18 | SOL4 | 2 | 24.31 (0.01) | 20.86 (0.23) | 1.17 (0.01) |

Examples 19-21 and Comparative Example H

The abrasive articles of Examples 19-21 and Comparative Example H demonstrate the efficacy of the inventive additive when applied to loftier, unreinforced nonwoven abrasive articles.

Example 19

Example 19 was prepared by applying 14 grains/24 square in. (59 g/m$^2$) of WAX1 to a commercially-available nonwoven abrasive hand pad (SCOTCH-BRITE 7447 PRO HAND PADS, VERY FINE GRADE, 6 IN×9 IN, 64926, from 3M Company, Saint Paul, Minn.) followed by heating at 275° F. for 15 minutes

Example 20

Example 20 was prepared identically to Example 19 with the exception that WAX2 was substituted for WAX1.

Example 21

Example 21 was prepared identically to Example 19 with the exception that WAX7 was substituted for WAX1.

Comparative Example H

Comparative Example H was the commercially-available nonwoven abrasive hand pad described in Example 19 without any additional treatment.

Examples 19-21 and Comparative Example H were tested according to the Schiefer Test. Results are reported in Table 6 (below).

TABLE 6

| | CUT, grams | | | | |
|---|---|---|---|---|---|
| EXAMPLE | 1000 Cycles | 2000 Cycles | 3000 Cycles | 4000 Cycles | Total Cut |
| Comparative. Example H | 0.043 | 0.026 | 0.023 | 0.019 | 0.111 |
| 19 | 0.035 | 0.029 | 0.027 | 0.024 | 0.115 |
| 20 | 0.037 | 0.03 | 0.028 | 0.026 | 0.121 |
| 21 | 0.04 | 0.032 | 0.032 | 0.03 | 0.132 |

All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A nonwoven abrasive article comprising:

a lofty open nonwoven fiber web comprising intertwined fibers;

an abrasive layer bonded to at least a portion of the lofty open nonwoven fiber web, the abrasive layer comprising abrasive particles retained in a binder composition; and a peripheral antiloading composition at least partially disposed on the abrasive layer, wherein the peripheral antiloading composition comprises at least 50 percent by weight of wax, wherein the wax has a melting point onset in the range of from 180° F. (82° C.) to 290° F. (143° C.).

2. A nonwoven abrasive article according to claim 1, wherein the peripheral antiloading composition comprises at least 95 percent by weight of the wax.

3. A nonwoven abrasive article according to claim 1, wherein the peripheral antiloading composition comprises at least 99 percent by weight of the wax.

4. A nonwoven abrasive article according to claim 1, wherein the wax comprises a microcrystalline polyethylene wax.

5. A nonwoven abrasive article according to claim 1, wherein the peripheral antiloading coating further comprises a binder material.

6. A nonwoven abrasive article according to claim 1, wherein the peripheral antiloading coating contains less than 20 percent by weight of fatty acid metal salts, ammonium salts, and boronic esters, boronic acids, amines, phosphine oxides, sulfones, sulfates, sulfonates, sulfoxides, and ammonium compounds combined.

7. A nonwoven abrasive article according to claim 1, wherein the peripheral antiloading coating contains less than 20 percent by weight of fluorine.

8. A method of abrading a workpiece, the method comprising:

frictionally contacting a nonwoven abrasive article with a workpiece, wherein the nonwoven abrasive article comprises: a lofty open nonwoven fiber web comprising intertwined fibers; an abrasive layer bonded to at least a portion of the lofty open nonwoven fiber web, the abrasive layer comprising abrasive particles retained in a binder composition; and a peripheral antiloading composition at least partially disposed on the abrasive layer, wherein the peripheral antiloading composition comprises at least 50 percent by weight of wax, wherein the wax has a melting point onset in the range of from 180° F. (82° C.) to 290° F. (143° C.); and moving the nonwoven abrasive article relative to the workpiece thereby abrading the workpiece.

* * * * *